US006062388A

United States Patent [19]

Ohayon

[11] Patent Number: 6,062,388

[45] Date of Patent: May 16, 2000

[54] STACKABLE BINS

[76] Inventor: Abraham Ohayon, 1345 E. 38th St., Brooklyn, N.Y. 11234

[21] Appl. No.: 09/103,742

[22] Filed: Jun. 24, 1998

[51] Int. Cl.[7] ..... B65D 21/00

[52] U.S. Cl. ..... 206/509; 206/507; 206/520

[58] Field of Search ..... 220/669; 206/509, 206/511, 507, 519, 520

[56] References Cited

U.S. PATENT DOCUMENTS

| | | | |
|---|---|---|---|
| 3,819,044 | 6/1974 | Bockenstette | 206/509 X |
| 4,189,052 | 2/1980 | Carroll et al. | 206/507 |
| 4,534,466 | 8/1985 | Wood | 206/520 X |
| 5,344,022 | 9/1994 | Stahl | 206/507 |
| 5,372,257 | 12/1994 | Beauchamp et al. | 206/509 X |

*Primary Examiner*—Steven Pollard
*Attorney, Agent, or Firm*—Frishauf, Holtz, Goodman, Langer & Chick, P.C.

[57] ABSTRACT

A stackable bin includes two spaced apart side walls, each having a front, rear, upper and lower edges; a rear wall having opposite side edges connecting the rear edges of the side walls together, an upper edge and a lower edge; the side walls and the rear wall being slightly inclined inwardly with respect to a vertical plane from the upper edge to the lower edge thereof such that the lower edges of the side walls and the rear wall fit within upper edges of side walls and a rear wall of a second, lower stackable bin; a bottom wall connected to lower portions of the side and rear walls; and a plurality of parallel, spaced apart vertically oriented ribs provided on outer surfaces adjacent the front and rear edges of the side walls, for supporting the stackable bin on the upper edges of the side walls of the second stackable bin, and for increasing structural rigidity of the side walls, at least some of the ribs including a notch in a lower end to receive the upper edges of the side walls of the second stackable bin and an outer interlocking tab at the lower end which engages outer surfaces of the side walls of the second stackable bin when the upper edges of the side walls of the second stackable bin are received in the notches, to hold the side walls of the second stackable bin in alignment and preventing outward movement thereof.

11 Claims, 4 Drawing Sheets

STACKABLE BINS

BACKGROUND OF THE INVENTION

The present invention relates generally to stackable bins, and more particularly, is directed to stackable bins dimensioned to hold consumer articles, such as shoes.

Stackable bins for holding articles are well known. In order to prevent relative movement between the bins while enabling a stacking relation, the lower periphery of each bin is typically provided with a horizontally oriented shoulder or wall that seats on an upper peripheral edge or shoulder of another such bin. However, in order to provide such shoulders, additional material is typically added about the periphery of the bin and/or the side walls of the bin are formed in a complex shape. In either case, the walls must generally be made thicker in large portions thereof. This is disadvantageous from a molding standpoint, since it not only requires additional material, but also presents problems such as the time for hardening of the material, warping of the material, and the like, as well as requiring the formation of complex molds.

Further, the aforementioned stacking arrangement presents problems in that the stackable bins can easily become disengaged from each other. This is because it is difficult, by means of the aforementioned shoulders, to maintain the stackable bins in the stacked arrangement. That is, a slight force typically can easily knock one stackable bin off of another.

In order to solve these problems, stackable bins have been proposed by the same inventor herein, and which is the subject matter of U.S. Pat. No. 5,593,037, issued Jan. 14, 1997, the entire disclosure of which is incorporated herein by reference. According to this patent, a stackable bin is provided having reinforcing ribs that perform a two-fold function of reinforcing the walls while also supporting the bin in a stacked arrangement, and in which there is a reliable interlocking arrangement of the bins in the stacked configuration thereof.

However, the bins proposed in this patent have a central partition wall. The partition wall has a four-fold function of 1) supporting the bins in a stacked relation, 2) dividing each bin into two compartments, 3) increasing the structural integrity of each bin, and 4) locking the bins in a stacked relation.

A problem occurs, however, if the bins are made of smaller dimension, and thereby without the central partition wall. Specifically, inner pressure from the goods in a stacked bin may cause the front ends of the side walls of the bin to move outwardly. This, in turn, can cause instability in the top bin, since the bottom of the top bin stacked thereon could fall down within the side walls of the lower bin.

SUMMARY OF THE INVENTION

It is an object of the present invention to provide a stackable bin that avoids the problems with the prior art.

Another object of the present invention is to provide a stackable bin having reinforcing ribs that perform a two-fold function of reinforcing the walls while also supporting the bin in a stacked arrangement.

It is another object of the present invention to provide a stackable bin that provides a reliable interlocking arrangement of the bins in the stacked configuration thereof.

A further object of the present invention is to provide a stackable bin in which the reinforcing ribs also have interlocking tabs that prevent outward movement of side walls of a lower bin.

A yet further object of the present invention is to provide a stackable bin that can be easily molded in a single piece.

In accordance with an aspect of the present invention, a stackable bin includes two spaced apart side walls, each having a front edge, a rear edge, an upper edge and a lower edge; a rear wall having opposite side edges connecting the rear edges of the side walls together, and the rear wall further having an upper edge and a lower edge; the side walls and the rear wall being slightly inclined inwardly with respect to a vertical plane from the upper edge to the lower edge thereof such that the lower edges of the side walls and the rear wall fit within upper edges of side walls and a rear wall of a second, lower stackable bin, to form a supporting stackable arrangement therewith; a bottom wall connected to lower portions of the side walls and the rear wall; and vertically oriented ribs provided on outer surfaces of the side walls, for supporting the stackable bin on the upper edges of the side walls of the second stackable bin, and for increasing structural rigidity of the side walls, at least some of the ribs including a notch in a lower end thereof to receive the upper edges of the side walls of the second stackable bin, and an outer interlocking tab at the lower end which engages outer surfaces of the side walls of the second stackable bin when the upper edges of the side walls of the second stackable bin are received in the notches, to hold the side walls of the second stackable bin in stacking alignment and preventing outward movement thereof.

Preferably, the lower edges of the side walls and the rear wall extend to a position lower than the bottom wall, and each rib is vertically oriented and has a lower edge at a position higher than the lower edge of the respective side wall.

Further, there are a plurality of the ribs in parallel spaced relation adjacent to the front edge of each side wall, and there are a plurality of the ribs in parallel spaced relation adjacent to the rear edge of each side wall. Preferably, there are three such ribs adjacent to the front edge of each side wall, and three such ribs adjacent to the rear edge of each side wall.

In addition, there is an arrangement for preventing forward sliding movement of the stackable bin when stacked on the second stackable bin, the arrangement for preventing forward sliding movement of the stackable bin including inwardly directed flanges at the front edges of the side walls for preventing forward movement of the stackable bin with respect to the second stackable bin.

These and other objects of the present invention are attained in accordance with the stackable bin configuration of the present invention which is described hereinafter.

DETAILED DESCRIPTION OF THE INVENTION

Figure 1:
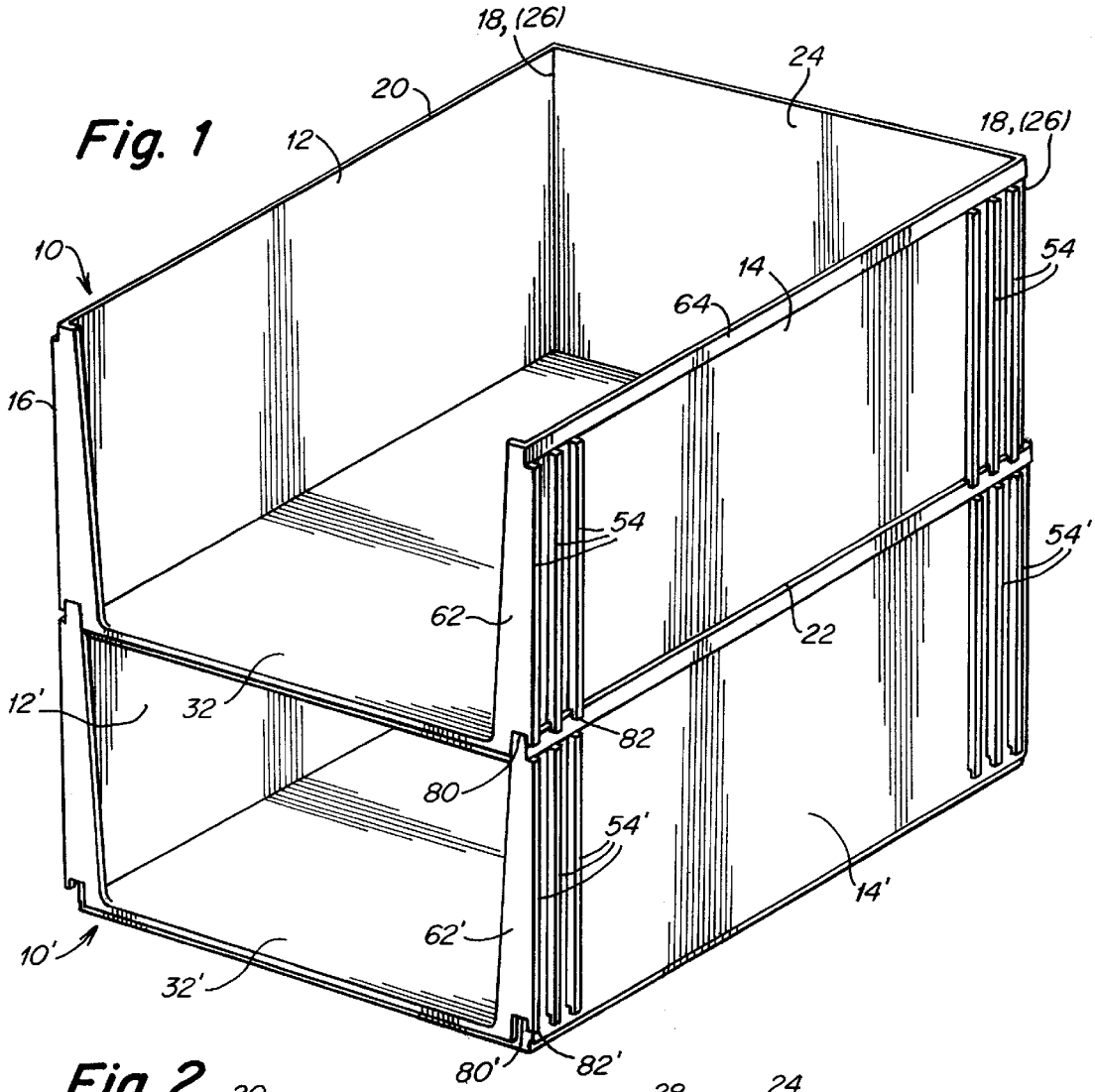
FIG. 1 is a perspective view of two stackable bins according to the present invention, shown in stacked relation.
Figure 2:
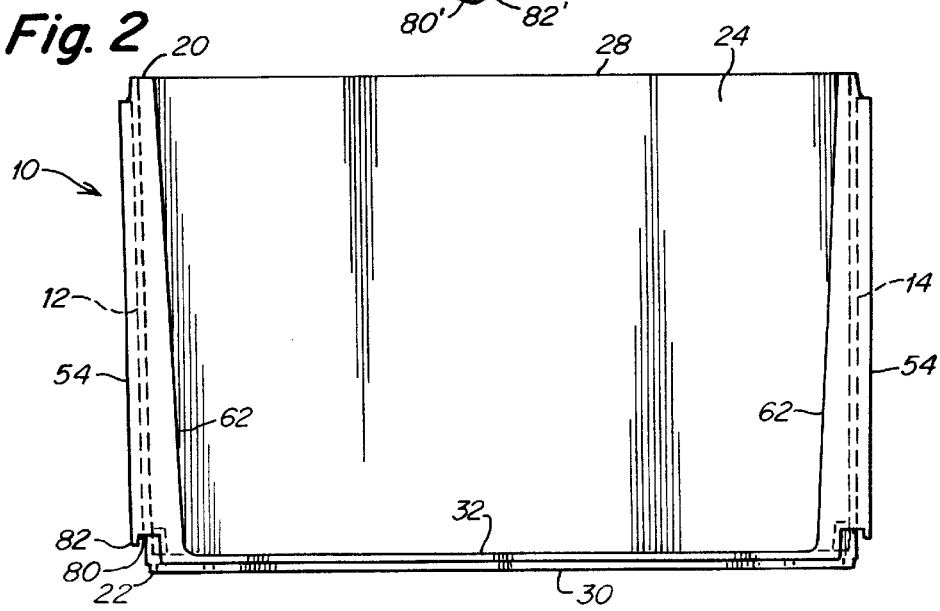
FIG. 2 is a front elevational view of one stackable bin of FIG. 1.
Figure 3:
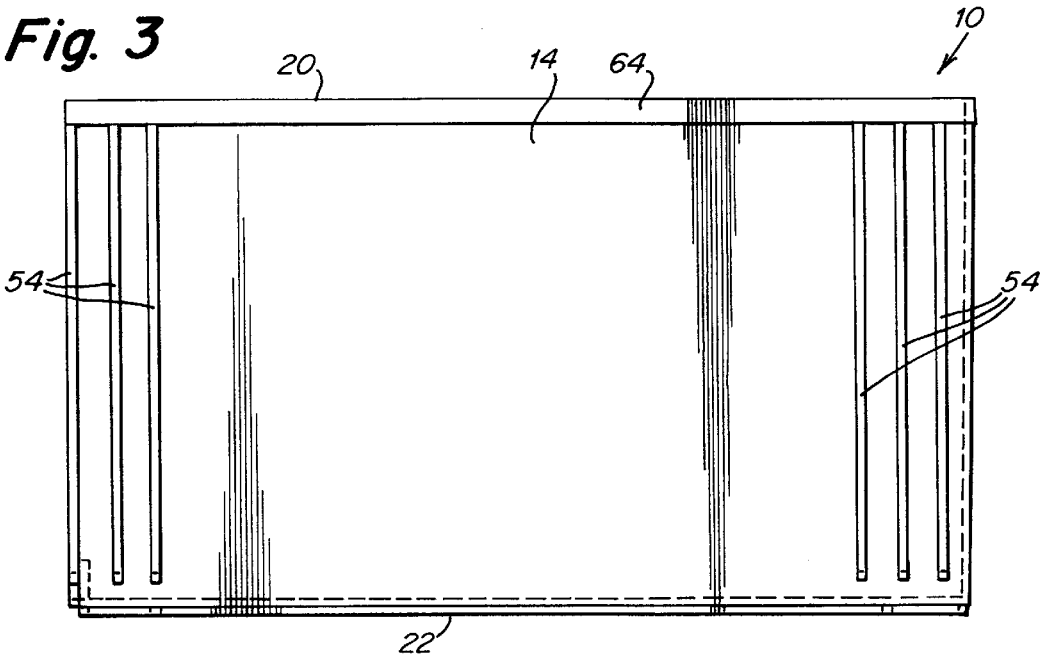
FIG. 3 is side elevational view of the stackable bin of FIG. 2.
Figure 4:
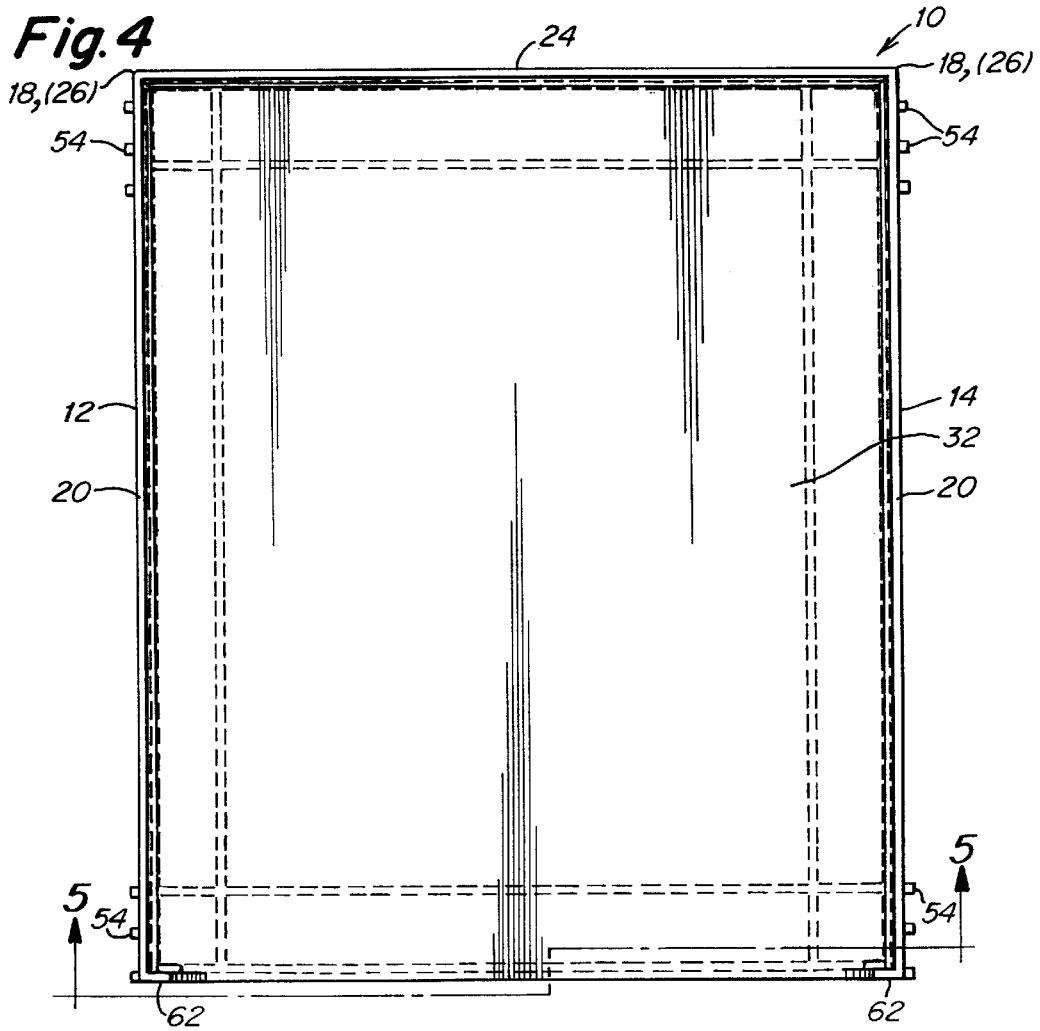
FIG. 4 is a top plan view of the stackable bins of FIG. 1.
Figure 5:
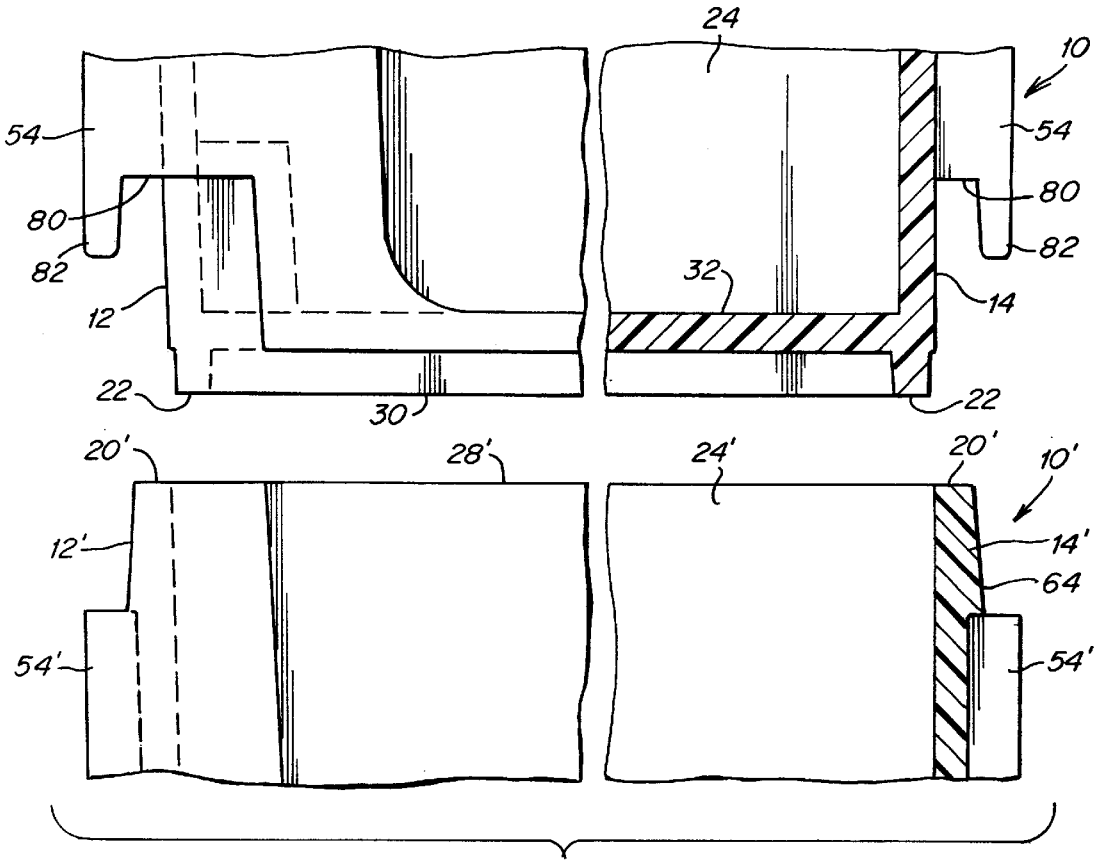
FIG. 5 is a front elevational view, partly in section, of the stacked bins of FIG. 5, taken along line 5—5, shown in the process of stacking one bin on the other.

Referring to the drawings in detail, a stackable bin 10 according to the present invention is formed as a homogeneous, uniform and one piece plastic material. Since the present invention will be described with reference to bins that are stackable, the notation to be used hereinafter refers to a prime (') after a numeral to represent the bottom one of two stacked bins, and a numeral by itself to represent the top bin of the two stacked bins and to describe the parts of a single bin in general.

Specifically, bin 10 includes two spaced apart side walls 12 and 14, each having a generally rectangular configuration with a front edge 16, a rear edge 18, an upper edge 20 and a lower edge 22. Although side walls 12 and 14 are described as preferably having a rectangular configuration, the present invention is not limited to this particular configuration.

Bin 10 further includes a rear wall 24 having opposite side edges 26 connecting rear edges 18 of side walls 12 and 14 together. Rear wall 24 further has an upper edge 28 and a lower edge 30. Rear wall 24 is also preferably formed in rectangular configuration, although it is not so limited.

Figure 6:
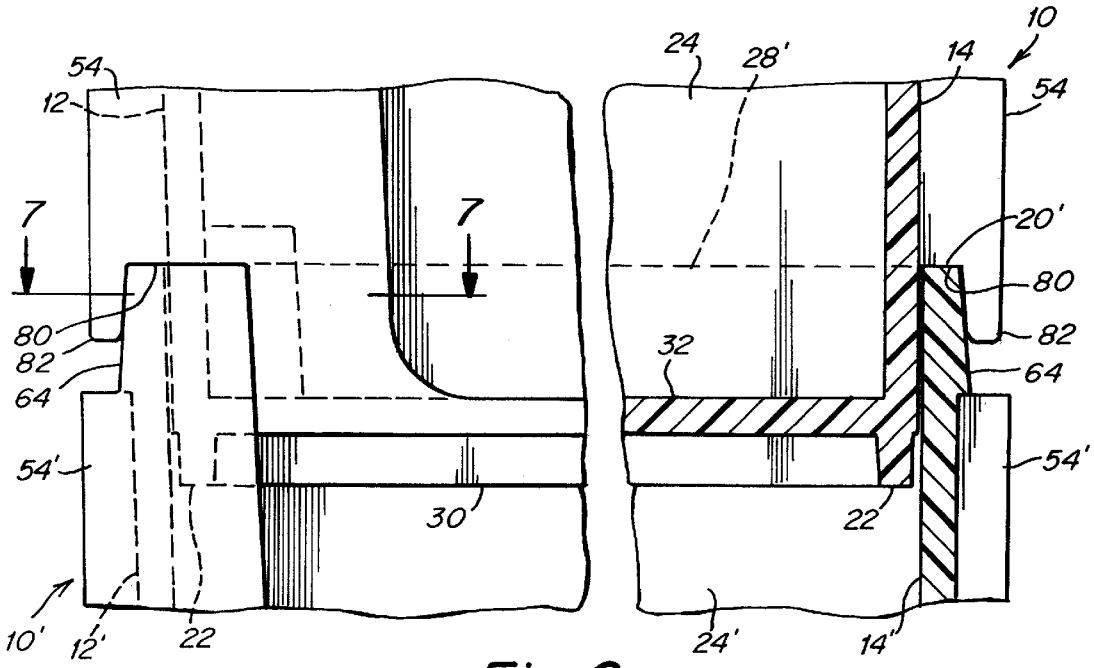
FIG. 6 is a front elevational view, partly in section, similar to FIG. 5, but with the bins stacked one on the other.

In addition, bin 10 includes a bottom wall 32 that is connected to lower portions of side walls 12 and 14 and a lower portion of rear wall 24, to close off the bottom of bin 10. As best shown in FIG. 6, side walls 12 and 14 and rear wall 24 extend slightly below bottom wall 32. That is, bottom wall 32 is connected at lower portions of side walls 12 and 14 and rear wall 24 at positions spaced slightly above lower edges 22 and 30 thereof.

Side walls 12 and 14 and rear wall 24 are each made of a generally thin sheet of relatively rigid plastic material having a substantially uniform thickness such that there is no need to provide any complex molds or very thick walls which would necessitate the use of a large amount of plastic material, as will become apparent from the discussion hereinafter.

Side walls 12 and 14 are slightly inclined or tapered inwardly with respect to a vertical plane from the upper edge 20 to the lower edge 22 thereof, such that lower edges 22 of side walls 12 and 14 of stackable bin 10 fit within upper edges 20' of side walls 12' and 14' of lowermost bin 10', as best shown in FIG. 6. In like manner, rear wall 24 is slightly inclined or tapered inwardly with respect to a vertical plane from the upper edge 28 to the lower edge 30 thereof, such that lower edge 30 of rear wall 24 of stackable bin 10 fits within upper edge 28' of rear wall 24' of bin 10', as also shown in FIG. 6. The inclination of walls 12, 14 and 24 permits bin 10 to be made as a single piece of plastic in a mold. That is, the inclination of walls 12, 14 and 24 permits the release of bin 10 from the mold while also providing the stacking arrangement as discussed hereinafter. For example, such taper or inclination can be about 1.5° with respect to the vertical.

Next, the arrangement for stacking bins 10 and 10', as well as increasing the structural rigidity and substantially preventing accidental escape of one bin from the stacked arrangement with another bin, will be discussed.

As a means of supporting bins 10 and 10' on top of each other, while further increasing the structural rigidity of side walls 12 and 14, and without adding great amounts of material thereto, vertically oriented ribs 54 are provided on outer surfaces of side walls 12 and 14 adjacent the front and rear edges 16 and 18 thereof. Although three spaced ribs 54 are shown provided at each end of each side wall 12 and 14, the present invention is not limited to this number or this positioning. As shown, ribs 54 do not extend down to lower edges 22 of side walls 12 and 14. Thus, as shown best in FIG. 6, the lower edges of ribs 54 function to support stackable bin 10 on upper edges 20' of side walls 12' and 14' of stackable bin 10', while also increasing the structural rigidity of side walls 12 and 14.

Bin 10 further includes means for preventing forward sliding movement of stackable bin 10 when stacked on stackable bin 10'. Specifically, inwardly directed flanges 62 are formed at the front edges 16 of side walls 12 and 14, along the entire height thereof. When the lower edges 22 of side walls 12 and 14 of bin 10 fit with the upper edges 20' of side walls 12' and 14' of bin 10', the lower edges 22 are prevented from moving forward by flanges 62, thereby further aiding in preventing sliding movement of bin 10 relative to bin 10'.

Figure 7:
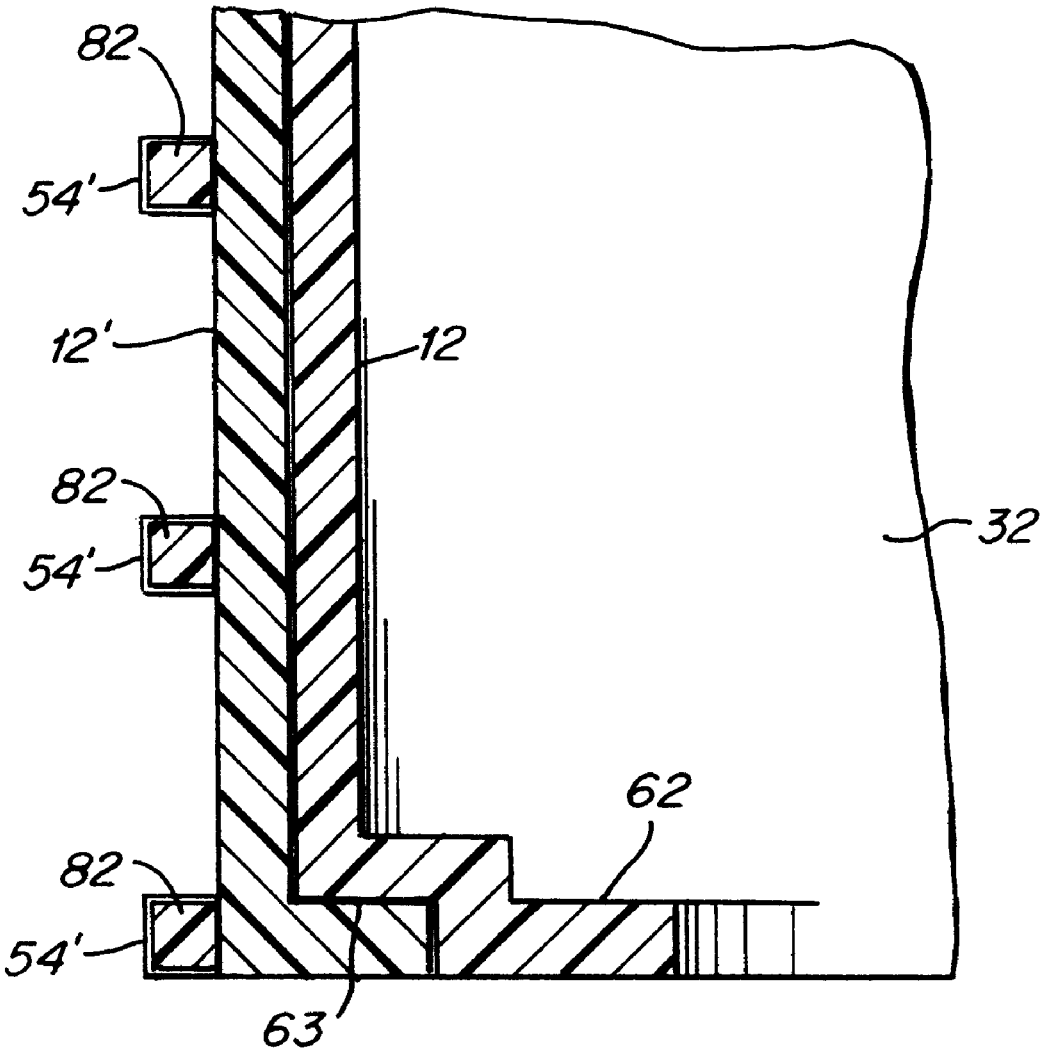
FIG. 7 is a cross-sectional view of the bins of FIG. 6, taken along line 7—7 thereof.

Specifically, side walls 12 and 14, bottom wall 32 and the forwardmost ribs 54 are cut away at the lower front corners of bin 10 to provide recessed areas 63 that receive the upper edges of flanges 62' of bin 10', thereby providing a flush arrangement at the front of the bins, as shown best in FIG. 7.

In order to further increase the rigidity of bin 10, without adding a large amount of material, the upper portions of side walls 12 and 14 and rear wall 24 have an increased thickness so as to define an upper peripheral lip 64. It will therefore be appreciated from the above that stackable bin 10 has reinforced walls, while not requiring an increase in the overall thickness of the walls. This is accomplished by means of reinforcing ribs 54 that perform a two-fold function of reinforcing the walls and supporting the bin in a stacked arrangement.

As discussed above, prior U.S. Pat. No. 5,593,037 to the same inventor, provided a central partition wall, thereby effectively providing a locking or interlocking arrangement. With such construction, the partition wall provided support for another bin, and also functioned to divide the bins into two compartments, while increasing the structural rigidity of the bin. Therefore, the partition wall served the four-fold function of 1) supporting the bins in a stacked relation, 2) dividing each bin into two compartments, 3) increasing the structural integrity of each bin, and 4) locking the bins in a stacked relation.

However, when smaller bins are used, or if it is not desired to separate the bins into compartments, the central partition of U.S. Pat. No. 5,593,037 is eliminated. In such case, however, a problem can result.

Specifically, inner pressure from the goods contained in stacked bin 10' may cause the front ends of side walls 12' and 14' of bin 10' to move outwardly. This, in turn, can cause instability in top bin 10, since the bottom of top bin 10 stacked thereon can fall down within side walls 12' and 14' of lower bin 10'.

Therefore, in accordance with the present invention, ribs 54 are constructed wider than the ribs of the aforementioned U.S. Pat. No. 5,593,037, and are cut-away at inner, lower ends thereof, to define notches 80 that receive the upper edges 20' of side walls 12' and 14'. Due to such cut-away portions, downwardly extending, interlocking tabs 82 are formed at the outer, lower ends of ribs 54, which engage the outer surfaces of side walls 12' and 14'.

Thus, interlocking tabs 82 function to hold side walls 12' and 14' in alignment, and prevent goods contained in bin 10' from pushing side walls 12' and 14' outwardly. Of course, it is not necessary that all of ribs 54 be provided with notches 80 and interlocking tabs 82.

Therefore, bins 10 and 10' can be made without any central partition, without the fear of the side walls 12' and 14' being biased outwardly by goods in bin 10', and thereby preventing top bin 10 from falling into lower bin 10'.

Having described a specific preferred embodiment of the invention with reference to the accompanying drawings, it will be appreciated that various modifications thereto can be effected by one of ordinary skill in the art without departing from the scope or spirit of the invention.

I claim:

1. A stackable bin comprising:

two spaced apart side walls, each having a front edge, a rear edge, an upper edge and a lower edge;

a rear wall having opposite side edges connecting said rear edges of said side walls together, and said rear wall further having an upper edge and a lower edge;

said side walls and said rear wall being slightly inclined inwardly with respect to a vertical plane from the upper edge to the lower edge thereof such that the lower edges of the side walls and the rear wall fit within upper edges of side walls and a rear wall of a second, lower stackable bin, to form a supporting stackable arrangement therewith;

a bottom wall connected to lower portions of said side walls and said rear wall;

vertically oriented ribs provided on outer surfaces of said side walls, for supporting said stackable bin on the upper edges of the side walls of said second stackable bin, and for increasing structural rigidity of said side walls, at least some of said ribs including:

a notch in a lower end thereof to receive the upper edges of the side wall of the second stackable bin, and an outer interlocking tab at said lower end which engages outer surfaces of said side walls of said second stackable bin when said upper edges of the side walls of the second stackable bin are received in said notches, to hold said side walls of the second stackable bin in stacking alignment and preventing outward movement thereof; and an arrangement for preventing forward sliding movement of said stackable bin when stacked on said second stackable bin, said arrangement for preventing forward sliding movement of said stackable bin including inwardly directed flanges at the front edges of said side walls, each said inwardly directed flange being cut away at a lower end thereof to define a zig-zag shape in horizontal section with a first portion thereof being positioned behind a corresponding inwardly directed flange of the second stackable bin and a second portion thereof being positioned inwardly of and flush with said corresponding inwardly directed flange of the second stackable bin, so as to present a flush appearance of the stackable bin with the second stackable bin, while preventing forward movement of said stackable bin with respect to said second stackable bin.

2. A stackable bin according to claim 1, wherein said lower edges of said side walls and said rear wall extend to a position lower than said bottom wall.

3. A stackable bin according to claim 1, wherein there are a plurality of said ribs in parallel spaced relation adjacent to the front edge of each said side wall, and there are a plurality of said ribs in parallel spaced relation adjacent to the rear edge of each said side wall.

4. A stackable bin according to claim 1, wherein there are three said ribs in parallel spaced relation adjacent to the front edge of each said side wall, and there are three said ribs in parallel spaced relation adjacent to the rear edge of each said side wall.

5. A stackable bin according to claim 1, where each said rib has a lower edge at a position higher than the lower edge of the respective said side wall.

6. A stackable bin comprising:

two spaced apart side walls, each having a front edge, a rear edge, an upper edge and a lower edge;

a rear wall having opposite side edges connecting said rear edges of said side walls together, and said rear wall further having an upper edge and a lower edge;

said side walls and said rear wall being slightly inclined inwardly with respect to a vertical plane from the upper edge to the lower edge thereof such that the lower edges of the side walls and the rear wall fit within upper edges of side walls and a rear wall of a second, lower stackable bin, to form a supporting stackable arrangement therewith;

a bottom wall connected to lower portions of said side walls and said rear wall;

a plurality of thin, parallel, spaced apart, vertically oriented ribs provided on outer surfaces of said side walls and extending in a direction substantially transverse to said outer surfaces of said side walls, for supporting said stackable bin on the upper edges of the side walls of said second stackable bin, and for increasing structural rigidity of said side walls, at least some of said ribs including:

a notch in a lower end thereof to receive the upper edges of the side wall of the second stackable bin, and an outer interlocking tab at said lower end which engages and lies substantially flush against outer surfaces of said side walls of said second stackable bin when said upper edges of the side walls of the second stackable bin are received in said notches, to hold said side walls of the second stackable bin in stacking alignment and preventing outward movement thereof; and an arrangement for preventing forward sliding movement of said stackable bin when stacked on said second stackable bin, said arrangement for preventing forward sliding movement of said stackable bin including inwardly directed flanges at the front edges of said side walls, each said inwardly directed flange being cut away at a lower end thereof to define a zig-zag shape in horizontal section with a first portion thereof being positioned behind a corresponding inwardly directed flange of the second stackable bin and a second portion thereof being positioned inwardly of and flush with said corresponding inwardly directed flange of the second stackable bin, so as to present a flush appearance of the stackable bin with the second stackable bin, while preventing forward movement of said stackable bin with respect to said second stackable bin.

7. A stackable bin according to claim 6, wherein two of said vertically oriented ribs extend outwardly from said side walls as forwardmost ribs in substantially parallel aligned relation to said second portions of said inwardly directed flanges, with said notches formed between said second portions and respective said forwardmost ribs.

8. A stackable bin according to claim 6, wherein said lower edges of said side walls and said rear wall extend to a position lower than said bottom wall.

9. A stackable bin according to claim 6, wherein there are a plurality of said ribs in parallel spaced relation adjacent to the front edge of each said side wall, and there are a plurality of said ribs in parallel spaced relation adjacent to the rear edge of each said side wall.

10. A stackable bin according to claim 6, wherein there are three said ribs in parallel spaced relation adjacent to the front edge of each said side wall, and there are three said ribs in parallel spaced relation adjacent to the rear edge of each said side wall.

11. A stackable bin according to claim 6, where each said rib has a lower edge at a position higher than the lower edge of the respective said side wall.

* * * * *